US005990467A

United States Patent [19]

Yang et al.

[11] Patent Number: 5,990,467

[45] Date of Patent: Nov. 23, 1999

[54] MICROWAVE OVEN HAVING IMPROVED STRUCTURE FOR FIXING A BLOWER

[75] Inventors: Ha-young Yang, Yongin; Jong-keun Kim, Suwon, both of Rep. of Korea

[73] Assignee: Samsung Electronics Co., Ltd., Suwon, Rep. of Korea

[21] Appl. No.: 09/158,505

[22] Filed: Sep. 23, 1998

[30] Foreign Application Priority Data

May 13, 1998 [KR] Rep. of Korea ..... 98-17102
May 13, 1998 [KR] Rep. of Korea ..... 98-17103

[51] Int. Cl.[6] ..... H05B 6/64

[52] U.S. Cl. ..... 219/757; 126/21 A

[58] Field of Search ..... 219/757, 681, 219/400, 756; 126/21 A

[56] References Cited

U.S. PATENT DOCUMENTS 5,371,343 12/1994 Yoshimura et al. ..... 219/746
5,393,961 2/1995 Umekage et al. ..... 219/757
5,477,036 12/1995 Jun et al. ..... 219/757

FOREIGN PATENT DOCUMENTS 1-194285 8/1989 Japan ..... 219/757
2-46690 2/1990 Japan ..... 219/757

*Primary Examiner*—Philip H. Leung
*Attorney, Agent, or Firm*—Burns, Doane, Swecker & Mathis, L.L.P.

[57] ABSTRACT

Disclosed is a microwave oven comprising, a body divided into a cooking chamber and a device chamber, a magnetron installed in the device chamber of the body, a high voltage condenser and a high voltage transformer, and a blower for cooling elements installed in the device chamber. The blower comprises a fan for forcedly blowing air, and a motor having a stator, a rotor, and at least one fixing rod. The stator is equipped with a bobbin with a coil wound thereon. The stator provides the fan with a driving force. The fixing rod is extended from the stator and coupled with a rear panel of the body. The fixing rod passes through the rear panel, and is formed with a screw part at an end part thereof which is assembled with a nut. The blower for cooling the devices for generating microwave is directly fixed onto the rear panel of the body without using a bracket. Accordingly, unit cost is reduced due to a reduced amount of elements. In addition, the number of processes for assembling the blower is reduced, and the assembling efficiency as well as a productivity increase.

5 Claims, 6 Drawing Sheets

MICROWAVE OVEN HAVING IMPROVED STRUCTURE FOR FIXING A BLOWER

BACKGROUND OF THE INVENTION

1. Field of the Invention

The present invention relates to a microwave oven cooking a food with microwave, and more particularly to a microwave oven having an improved structure for fixing a blower so that the latter is easily assembled with a reduced amount of components.

2. Prior Art

Generally, a microwave oven is an appliance for cooking a food with microwave of high frequency. The microwave oven is popularly used for its advantage that it cooks the food in a relatively short period of time while it maintains the original shape of a cooked object.

Such a microwave oven is installed with various electric elements such as a high voltage transformer, a magnetron, and a high voltage condenser for producing the microwave of high frequency. Accordingly, the microwave oven has an excessive heat within an inner portion thereof, and is equipped with a blower for cooling the heat.

The blower is generally fixed to a rear panel of the microwave oven with a bracket, which is briefly described as follows with reference to the drawing.

FIG. 1 shows a blower fixing structure of a conventional microwave oven.

As shown, the bracket 3 for fixing the blower 2 onto the rear panel 1*a* is a square frame formed with an receiving opening 3*a* in which the blower 2 is received. Also, at the inner circumferential surface of the receiving opening 3*a*, a fixing piece (not shown) having fixing holes for fixing the blower 2 is formed.

More specifically, the blower 2 is fixed to the bracket 3 by a bolt in a state of being received into the receiving opening 3*a* of the bracket 3, and the bracket 3 is fixed onto the rear panel 1*a* by the bolt.

Reference numeral 4 denotes a magnetron, reference numeral 5 denotes a high voltage transformer, and reference numeral 6 denotes a high voltage condenser.

In the conventional art, however, since the blower is fixed onto the rear panel with the bracket, a lot of processes are taken to assemble the blower and thereby the productivity decreases. Moreover, since additional elements such as the bracket, bolt for fixing the bracket onto the rear panel, and etc. are required to assemble the blower, unit cost also increases.

SUMMARY OF THE INVENTION

Accordingly, an object of the present invention is to provide a microwave oven of improved structure for fixing a blower so that the blower can be fixed onto a rear panel without a bracket, thereby have a reduced amount of components employed thereto and increase productivity thereof.

In order to accomplish above object, the microwave oven according to the present invention comprises, a body divided into a cooking chamber and a device chamber, a magnetron installed in the device chamber of the body, a high voltage condenser and a high voltage transformer, and a blower for cooling elements installed in the device chamber. The blower comprises a fan for forcedly blowing air, and a motor having a stator, a rotor, and at least one fixing rod. The stator is equipped with a bobbin with a coil wound thereon. The stator provides the fan with a driving force. The fixing rod is extended from the stator and coupled with a rear panel of the body.

The fixing rod passes through the rear panel of the body, and is formed with a screw part at an end part thereof which is assembled with a nut. The blower is fixed to the rear panel of the body by the fixing rod which passes through the openings formed on the rear panel and lastly is assembled with the nut.

A member for absorbing vibration generated by the rotation of the motor is disposed between the fixing rod and the rear panel of said body, and a washer for preventing release of the nut is disposed between the rear panel of the body and the nut for tightening the fixing rod.

According to the present invention, the blower for cooling the devices for generating microwave is directly fixed onto the rear panel of the body without using a bracket. Accordingly, unit cost is reduced due to a reduced amount of elements. In addition, the number of processes for assembling the blower is reduced, and the assembling efficiency as well as a productivity increase.

BRIEF DESCRIPTION OF THE DRAWINGS

The above object and advantages will be more apparent by describing preferred embodiments of the present invention with reference to accompanying drawings, in which.

DESCRIPTION OF THE PREFERRED EMBODIMENT

Figure 1:
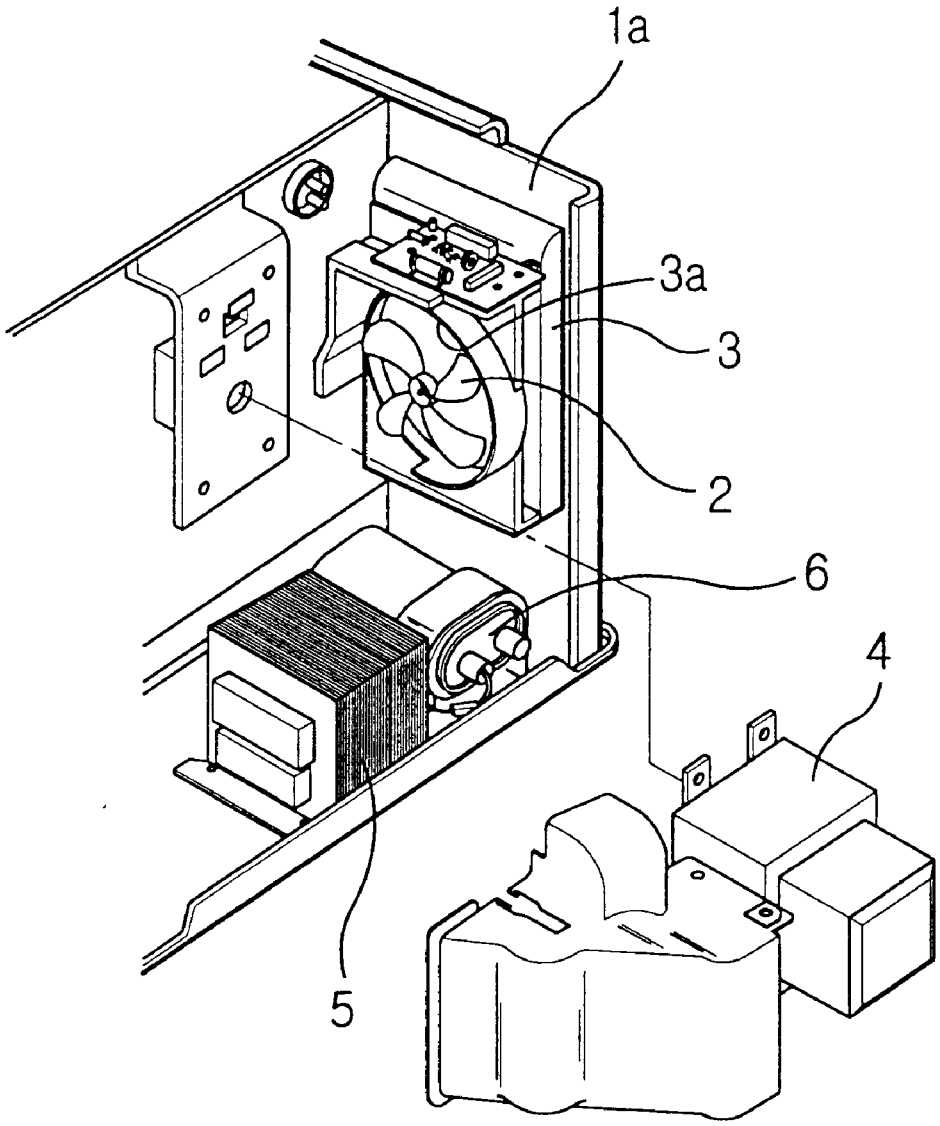
FIG. 1 (PRIOR ART)
FIG. 1 is a partial perspective view of a conventional microwave oven showing a structure for fixing a blower.
Figure 2:
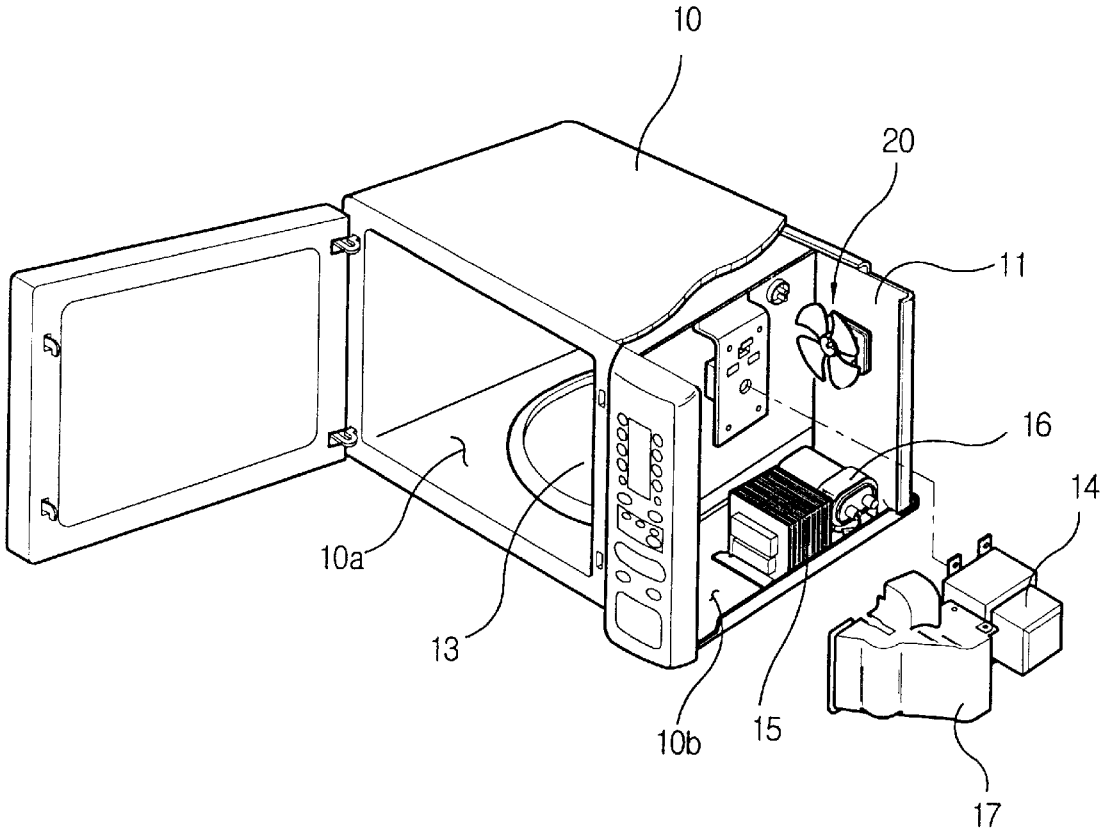
FIG. 2 is a perspective view of a microwave oven according to the first preferred embodiment of the present invention.
Figure 3:
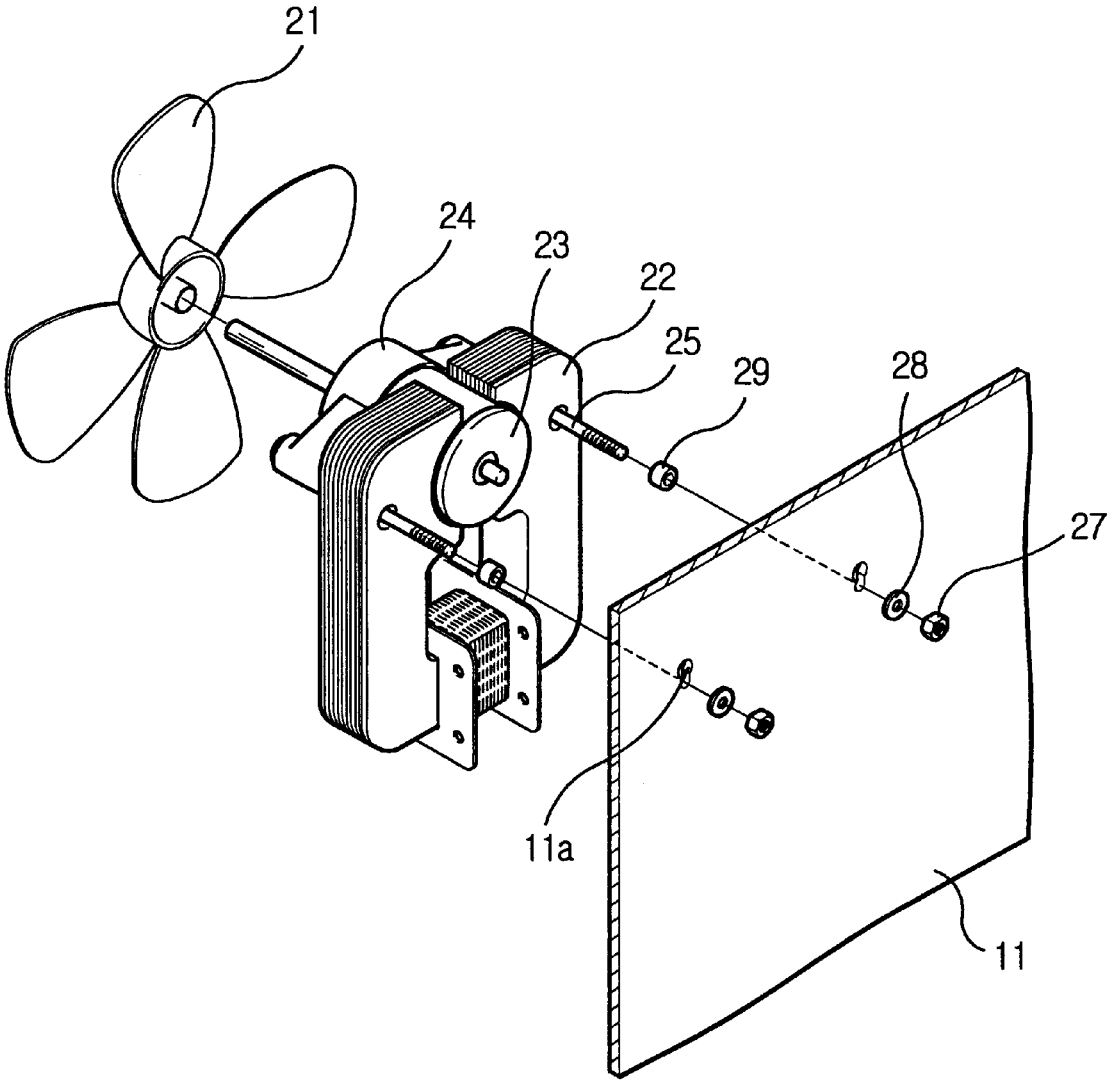
FIG. 3 is an exploded perspective view showing a fixing section of a blower shown in FIG. 2 in greater detail.
Figure 4:
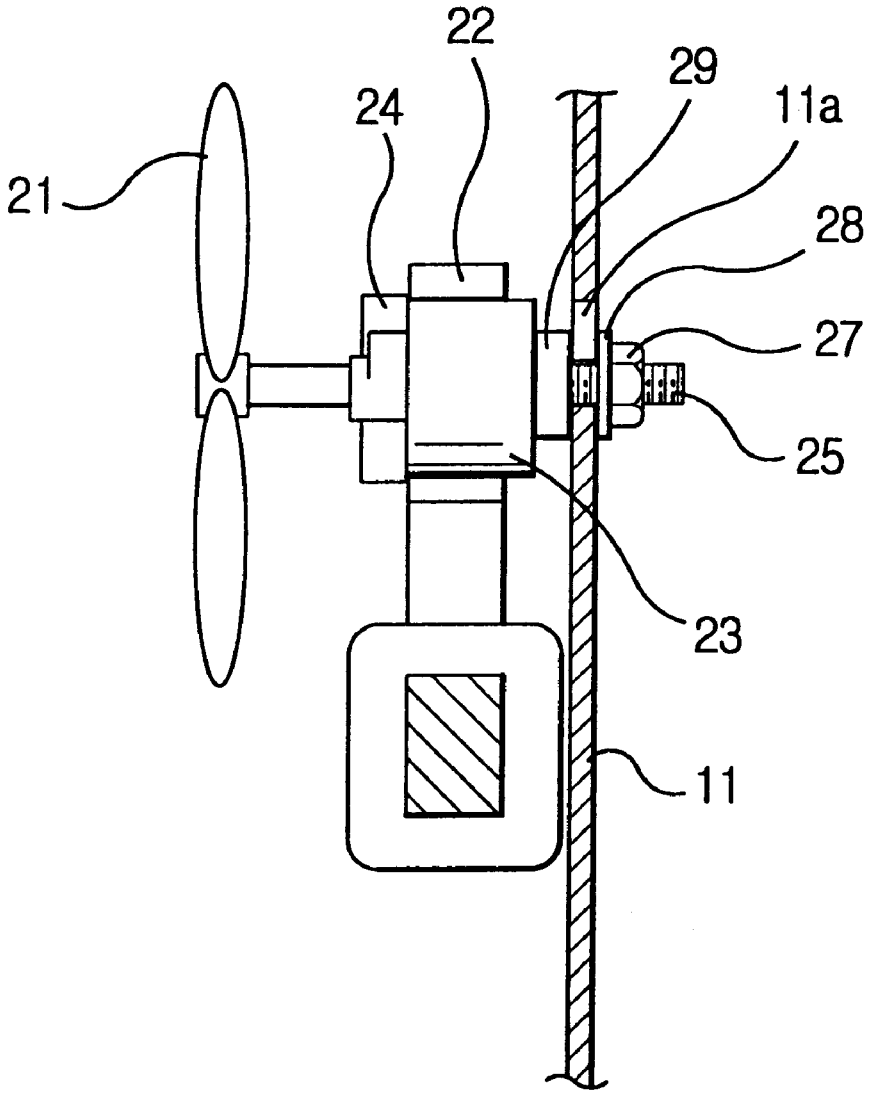
FIG. 4 is a sectional view of FIG. 3 in a fixed state.

A microwave oven according to the first preferred embodiment of the present invention is shown in FIGS. 2 through 4.

Reference numeral 10 in the drawing denotes a body of a microwave oven which is constructed with a plurality of panels and divided into a cooking chamber 10*a* and a device chamber 10*b*.

The cooking chamber 10*a* serves as a space where a food is received and cooked. A rotatable tray 13 is installed at the bottom thereof. A rotating motor (not shown) for rotating the rotatable tray 13 during a cooking operation is installed at a lower portion of the rotatable tray 13. Accordingly, the food is uniformly cooked.

The device chamber 10*b* is installed with various electric elements such as a magnetron 14 for producing microwave required for cooking operation, a high voltage transformer 15, a high voltage condenser 16, and a wave guide 17 for guiding the microwave into the cooking chamber 10*a*.

In addition, the blower 20 for cooling above electric elements installed in the device chamber 10*b* is fixed onto a rear panel 11 of a body 10.

As shown in greater detail in FIGS. 3 and 4, the blower 20 includes a fan 21 and a motor. The motor includes a stator 22 and a rotor 23. The rotor 23 of the motor is fixed with respect to the stator 22 by a motor bracket 24. A pair of fixing rods 25 are installed at the stator 22. The fixing rods 25 pass through the motor bracket 24 and the stator 22 and are extended toward the rear part of the motor. The fixing rods 25 are fixed to the motor bracket 24 by a fixing treatment such as a welding. Additionally, a screw part are formed at the rear end part of the fixing rods 25.

The rear panel 11 which the blower 20 is fixed onto is formed with a pair of rod openings 11*a* corresponding to the fixing rods 25. More specifically, first openings have a larger diameter than that of fixing rods 25, and second openings which are downwardly extended from the first openings have a similar diameter with that of the fixing rods 25.

Therefore, a pair of fixing rods 25 pass through first openings of the openings 11*a*, and then is positioned into the second openings of the openings 11*a*. Then, as the nuts 27 respectively assembled with the fixing rods 25, the blower 20 is completely fixed onto the rear panel 11 of the microwave oven.

Preferably, washers 28 are employed when the nuts 27 are coupled so as to tighten the nut 27 more firmly.

Preferably also, a ring-shaped member 29 made of a material absorbing vibration such as a rubber can be disposed between the stator 22 and the rear panel 11. Then, the transmission of the vibration generated from the motor to the rear penal 11 can be reduced.

Described preferred embodiment shows the example that a pair of fixing rods are employed to fix the blower on the rear panel, however, the number of fixing rods is not limited as long as the same surely fix the blower onto the rear panel.

Figure 5:
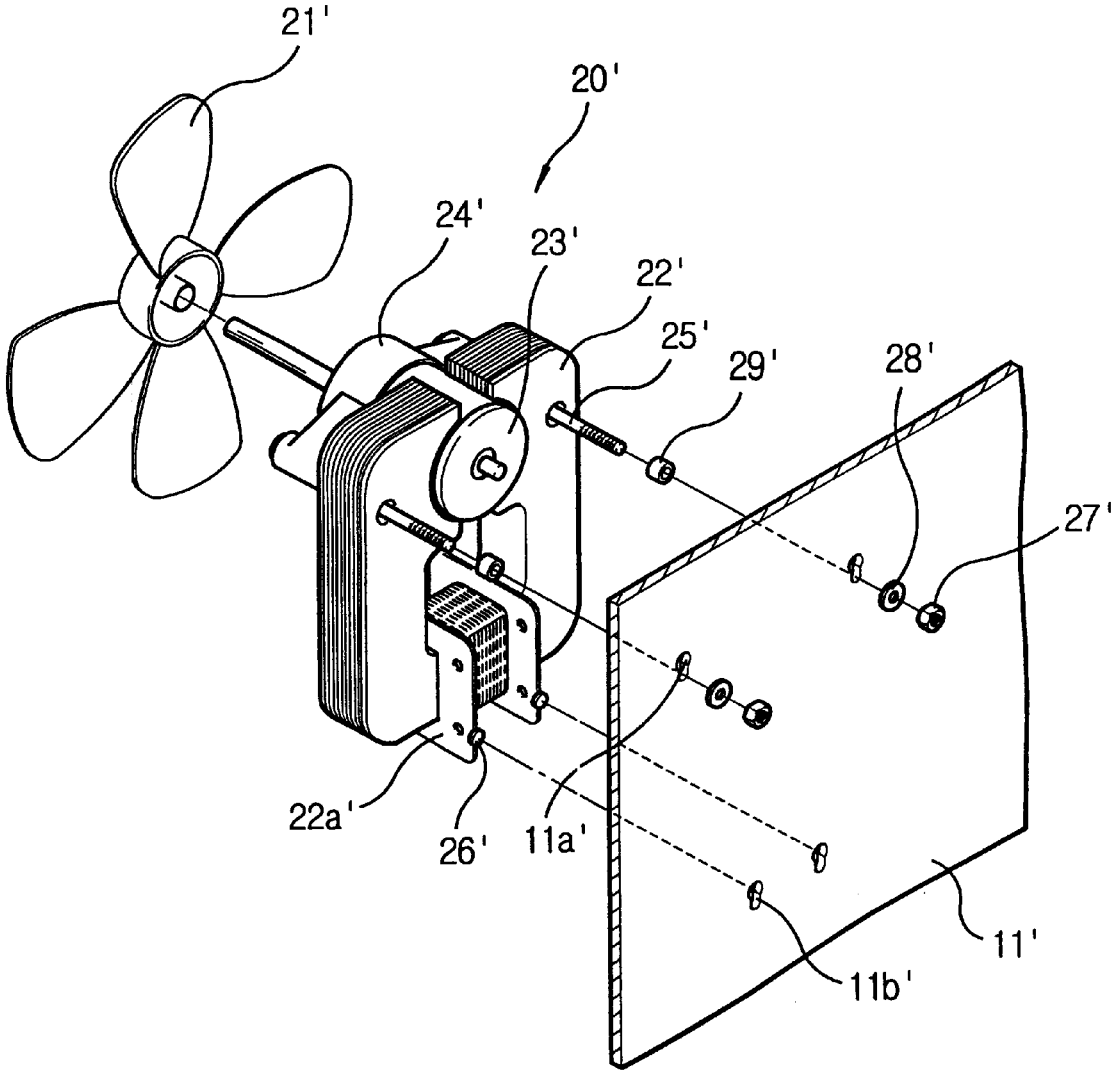
FIG. 5 is an exploded perspective showing a structure for fixing a blower according to the second preferred embodiment of the present invention.
Figure 6:
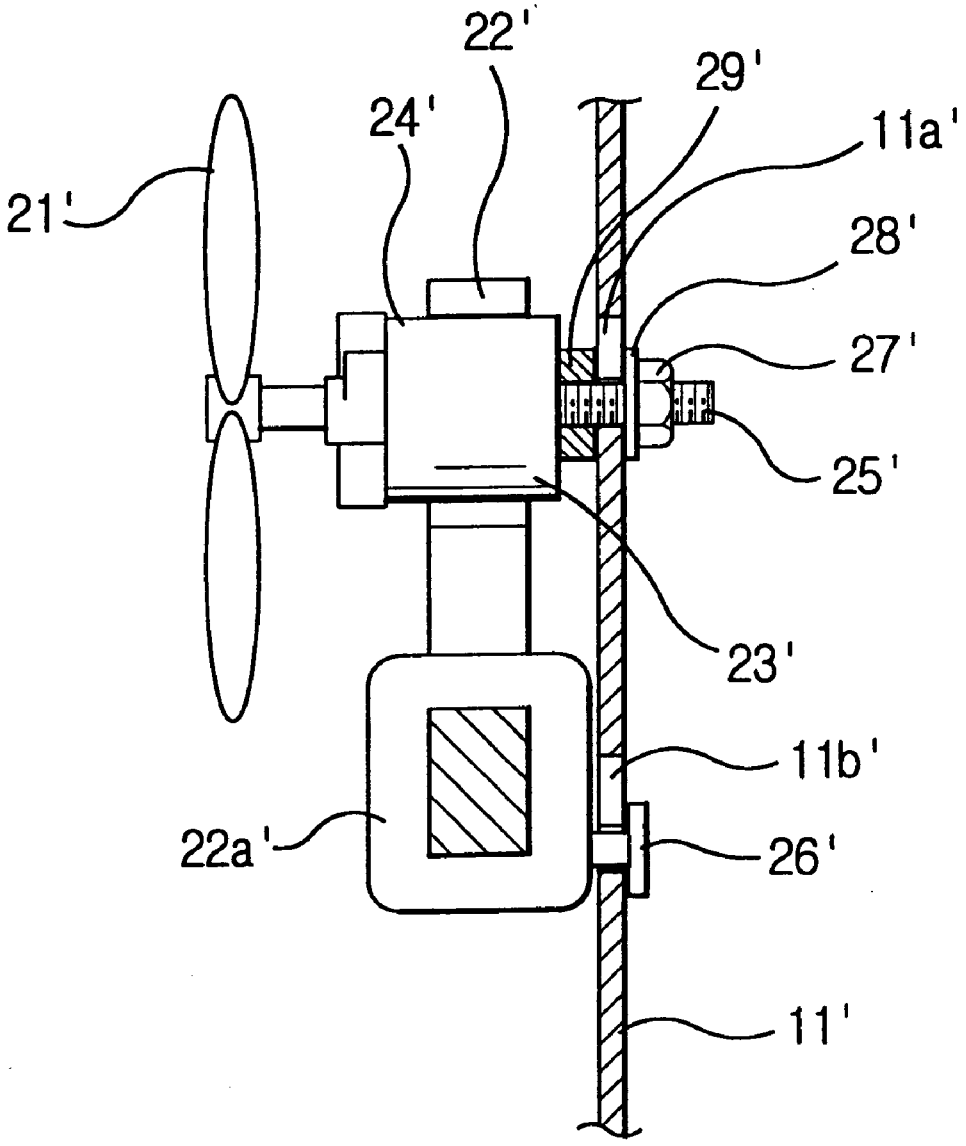
FIG. 6 is a sectional view of FIG. 5 in a fixed state.

Meanwhile, FIGS. 5 and 6 show a structure for fixing the blower according to the second preferred embodiment of the present invention.

As shown, the blower according to the second preferred embodiment of the present invention further comprises a pair of locking protrusions 26'.

More specifically, a bobbin 22*a*' constructing the motor with the rotor 23' is formed with a pair of locking protrusions 26'. The locking protrusions 26' are manufactured by an injection molding together with the bobbin 22*a*' during the manufacturing process of the bobbin 22*a*'.

The rear panel 11' which the blower 20' is fixed onto is formed with a pair of locking openings 11*b*' as well as a pair of openings 11*a*' which the fixing rods 25' are inserted into. The locking openings 11*b*' locks the locking protrusions 26'. The shape of the locking openings 11*b*' are identical to those of the openings 11*a*'. More specifically, first openings have a diameter larger than the largest diameter of the locking protrusions 26', and second openings have a diameter similar with the smallest diameter of the locking protrusions 26'.

Thus, a pair of fixing rods 25' respectively pass through the first openings and then are positioned into the second openings. Likewise, a pair of locking protrusions 26' pass through first locking openings of the locking openings 11*a*' and then are positioned into the second locking openings thereof. Lastly, as the nuts 27' are assembled with the fixing rods 25' from the rear portion of the rear panel 11'; the blower 20' is fixed onto the rear panel 11'.

According to the second preferred embodiment described above, a pair of locking protrusions 26' as well as the fixing rods 25' fix the blower 20'. Therefore, a vibration and a noise generated by the motor can be reduced much more, since the blower 20' is fixed onto the rear panel more firmly in comparison with the case that the blower 20' is fixed onto the rear panel 11' only by a pair of fixing rods.

According to the present invention, the blower for cooling the devices for generating microwave is directly fixed onto the rear panel of the body without using the bracket. Accordingly, unit cost is reduced due to a reduced amount of elements. In addition, the number of processes for assembling the blower is reduced, and the assembling efficiency as well as a productivity increase.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A microwave oven comprising:

a body divided into a cooking chamber and a device chamber, said body including a rear panel formed with rod openings and locking openings spaced from said rod openings, said rod openings and said locking openings extending through said rear panel;

a magnetron installed in said device chamber of said body for producing microwaves;

a high voltage condenser and a high voltage transformer;

a blower for cooling elements installed in said device chamber, said blower including a fan for forcedly blowing air, and a motor having a stator, a rotor, and fixing rods, said stator being equipped with a bobbin with a coil wound thereon and locking protrusions which are integrally formed with said bobbin, said fixing rods being fixed to and extended from said stator; and vibration absorbing members, disposed between said fixing rods and said rear panel, for absorbing vibration generated by said motor;

whereby said fixing rods pass through respective ones of said absorbing members and through the respective ones of said rod openings, and said locking protrusions pass through respective ones of said locking openings and are locked therein, so that said blower is coupled with said rear panel.

2. The microwave oven as claimed in claim 1, wherein each of the respective rod openings includes a first opening having a diameter larger than that of said respective fixing rods, and a second opening linked with the first opening and having a smaller diameter than said first opening to firmly position said rod against movement.

3. The microwave oven as claimed in claim 1, wherein said locking protrusions are integrally formed with said bobbin by an injection molding.

4. The microwave oven as claimed in claim 3, wherein the respective locking openings include a first locking opening having a diameter larger than the largest diameter of said locking protrusions, and a second opening linked with the first locking opening and having a diameter identical to the smallest diameter of the respective locking protrusions.

5. The microwave oven as claimed in claim 1, wherein said vibration absorbing members have a ring-shape and are made of rubber.

* * * * *